US005622261A

United States Patent [19]

Mobley et al.

[11] Patent Number: 5,622,261

[45] Date of Patent: Apr. 22, 1997

[54] MERCHANDISING DISPLAY DEVICE HAVING INFLATABLE DECORATIVE COVERING

[75] Inventors: Stephen M. Mobley, Marietta; Ladd M. Orr, Clarkston; J. David Robertson, Atlanta, all of Ga.

[73] Assignee: The Mead Corporation, Dayton, Ohio

[21] Appl. No.: 424,853

[22] Filed: Apr. 19, 1995

[51] Int. Cl.[6] ..... B65D 73/00

[52] U.S. Cl. ..... 206/457; 206/216; 206/522; 220/739; 220/903

[58] Field of Search ..... 206/457, 522, 206/216, 315.6; 220/737, 739, 903

[56] References Cited

U.S. PATENT DOCUMENTS

| | | | |
|---|---|---|---|
| D. 343,327 | 1/1994 | Bailey et al. | D7/301 |
| 1,638,431 | 8/1927 | Brosi | 206/457 |
| 1,756,048 | 4/1930 | Williams | 206/457 |
| 2,729,259 | 1/1956 | Abrams | 150/52 |
| 3,803,738 | 4/1974 | Weiss | 40/306 |
| 4,705,085 | 11/1987 | Brown | 220/903 |
| 4,858,755 | 8/1989 | Kuivanen | 206/522 |
| 4,941,754 | 7/1990 | Murdock | 206/522 |
| 4,946,032 | 8/1990 | Stoddard et al. | 206/44 R |
| 4,950,196 | 8/1990 | Fortune et al. | 206/457 |
| 5,048,171 | 9/1991 | Bedwell et al. | 29/401.1 |
| 5,169,020 | 12/1992 | Spamer | 220/444 |
| 5,219,309 | 6/1993 | Hart | 441/136 |
| 5,358,763 | 10/1994 | Zinbarg | 206/457 |
| 5,366,075 | 11/1994 | Mills | 206/315.6 |
| 5,427,346 | 6/1995 | Urgola | 206/216 |

FOREIGN PATENT DOCUMENTS

| | | | |
|---|---|---|---|
| 4038682 | 6/1992 | Germany | 220/739 |

*Primary Examiner*—David T. Fidei
*Attorney, Agent, or Firm*—Tsugihiko Suzuki

[57] ABSTRACT

A merchandising display device having an upright tubular housing and a removable decorative covering is disclosed. The housing has an open top for permitting access to merchandise contained in the housing. The covering is of a deflatably air-inflated sleeve structure and is disposed around the housing so as to cover the outside surface of the housing. The covering includes an outer wall which defines the outer perimeter of the sleeve structure. The covering is formed of air-impervious flexible sheet material such that the outer wall is bulged outwardly due to internal pressure of the covering to provide a contour different from the contour of the housing.

12 Claims, 3 Drawing Sheets

MERCHANDISING DISPLAY DEVICE HAVING INFLATABLE DECORATIVE COVERING

BACKGROUND OF THE INVENTION

The present invention relates generally to merchandising display devices and, more particularly, to a barrel-type display device having a removable or changeable decorative covering of an air-inflatable construction.

A variety of devices are known for use as merchandising displays. Such displays are located in retail establishments to present products in such a manner as to attract attention of a potential purchaser. One type of display known as a barrel-type display cooler comprises a bin-like or tub-like structure into which the retail product is loaded and then removed for purchase from the top of the display. Such a display often utilizes a waterproof internal compartment, and may be used for the merchandising of single-serving cans and bottles of beverages. The compartment is partially filled with ice, with the beverage containers being placed into the ice to maintain the product in a cold condition. Examples of such devices may be found, or example, by reference to U.S. Pat. Nos. 4,946,032 and 5,048,171.

Another type of merchandising display is known as a barrel-type refrigerator which uses an electrically operated refrigerating system instead of ice to refrigerate or freeze a food product in an internal food compartment. An example of such a refrigerator is disclosed for example in U.S. patent application Ser. No. 08/373,962 filed Jan. 16, 1995 and owned by the assignee of the present invention.

Barrel-type display coolers and refrigerators frequently have applied to the external surface thereof some sort of attractive graphics representation in order to catch the attention of a prospective purchaser of the displayed product. Typically, such graphics are applied to the exterior of the display device in the form of a label, decal, panel or other essentially semi-permanent and/or virtually flat form. Where the graphics representation is a product specific label such as the one adhered to the display device and featuring the brand name of a particular beverage, the display device is limited in its use in that it cannot be used for a variety of products. Some of the graphics are changeable. However, those changeable require the display device to have certain retaining means such as a bracket for slidably engaging a graphics panel to removably retain the same on the exterior of the device. Further, these changeable graphics panels can vary the appearance of the device only graphically; they are not capable of changing the shape or contour of the device.

What is needed, therefore, is an easily removable and/or changeable decorative covering which can be used on and in association with the barrel-type display cooler or refrigerator.

SUMMARY OF THE INVENTION

The present invention provides a merchandising display device comprising an upright tubular housing having an open top for permitting access to merchandise in the housing, and a removable decorative covering of a deflatably air-inflated sleeve structure. The covering is disposed around the housing so as to cover at least a part of the outside surface of the housing without blocking the open top. The covering comprises an outer wall which defines the outer perimeter of the sleeve structure. The covering is formed of air-impervious flexible sheet material such that the outer wall of the covering is bulged outwardly due to internal pressure of the covering.

According to the invention, the covering can cover and hide whatever graphics originally on the housing surface and thereby enables the display device to be used for a variety of products. Also, the outwardly bulged outer wall can provide a contour completely different from the contour of the housing. Such a contour of the outer wall can be designed to assume any unique/interesting shape rather than the plain shapes such as having a straight, tapered or slightly curved contour which are available from the existing barrel-type display devices. Furthermore, the surface provided by the outwardly bulged outer wall is not a flat one but a three-dimensional surface raised and spaced from the outside surface of the housing. Such a three-dimensional surface can be turned into an attention-attractive billboard area once provided with graphics such as designs, words, logos and/or advertisements.

In a preferred embodiment, the covering has an inner wall which defines the inner perimeter of the sleeve structure. Due to the internal pressure, the inner wall is pressed inwardly against the housing and thereby the structure is frictionally retained on the housing without particular means for retaining the covering on the housing. The inner and outer wall may be joined together to define a substantially annular air chamber therebetween.

According to a preferred embodiment, the covering when deflated has an inner perimeter no less than the outer perimeter of the tubular housing. This arrangement facilitates application and removal of the covering to and from the housing. Accordingly, it is easy to remove the covering from the housing or to replace the covering with a differently shaped covering of the same Structure for the purpose of converting the display device into a new device of a different appearance.

According to a preferred embodiment, the covering has an extension extending upwardly to a position above the open top of the housing. Such an extension may include a head portion disposed above the open top and a neck portion connecting between the head portion and the outer wall of the covering. The head portion may have a front wall for providing a billboard surface. Alternatively, the head portion may have a shade means, such as an umbrella-shaped portion, for shading the open top of the housing.

The present invention also provides a decorative covering for disposition around a merchandising display device. The covering is of an air-inflatable sleeve structure and comprises an outer wall which defines the outer perimeter of the structure. The sleeve structure is formed of air-impervious flexible sheet material such that when the structure is inflated, the outer wall is bulged outwardly to provide a contour different from the contour of the housing.

The present invention further provides a merchandising display device comprising an upright tubular housing having a food-chilling compartment and a deflatably air-inflated sleeve structure disposed around the housing. The structure is formed of air-impervious flexible sheet material such that air is confined in the structure to form a heat-insulating layer surrounding the housing.

The objects and advantages of the present invention will be apparent from the following description, the accompanying drawings and the appended claims.

DESCRIPTION OF THE DRAWINGS

In the drawings,

FIG. 4 is a side elevation of the device in FIG. 1, showing the condition wherein the covering is deflated while on the housing; and.

Detailed Description of the Preferred Embodiment

Figure 1:
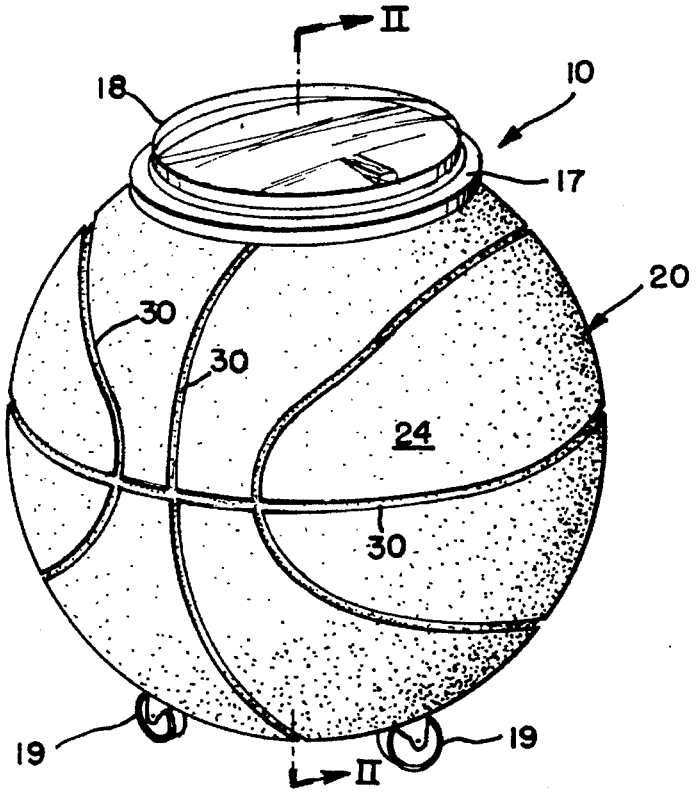
FIG. 1 is a perspective view of a merchandising display device according to the present invention.
Figure 2:
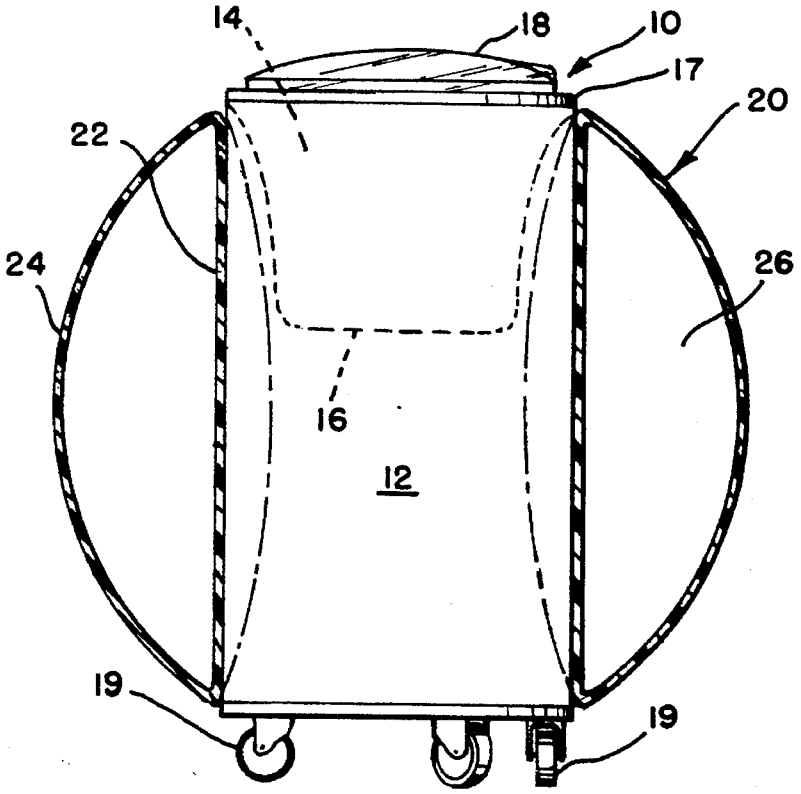
FIG. 2 is a view taken along the line II—II in FIG. 1.

A merchandising display device in accordance with the invention may be seen generally by reference to FIGS. 1 and 2. The display device includes a barrel-type refrigerator 10 having a hollow cylindrical outer housing 12. The refrigerator 10 incorporates an electrically operated refrigerating system including a food-chilling/freezing compartment 14 defined by an internal tub or liner 16 in the housing 12. Details of such a refrigerating system are described in U.S. patent application Ser. No. 08/373,962 filed Jan. 16, 1995 and owned by the assignee of the present invention, which is hereby incorporated by reference. The housing 12 provides the external structure of the refrigerator 10, as well as a support for the tub 16 wherein a food product may be placed for retail display.

The housing 12 may be formed of any material which can provide the housing 12 with structural strength great enough to carry the load applied by the tub 16 and its contents. However, in a preferred embodiment, the housing 12 is formed from a plastic material using, for example, a blow molding technique. The tub 16 is preferably molded also from a plastic material and has an outwardly extending annular support flange 17 which is positioned on the upper edge of the housing 12. The tub 16 is secured to the housing 12 by means of rivets or the like through the flange 17.

The refrigerator 10 includes a lid 18 which is hingedly connected to the flange 17 of the tub 16 and provides a closure for the open top of the housing 12. The lid 18 is preferably formed from a transparent material so that the product contained within the compartment 14 may be easily seen. Reference numeral 19 designates casters secured to the bottom of the refrigerator 10.

A removable decorative covering 20 is disposed around the refrigerator 10 to cover the entire outside surface of the housing 12 without blocking the open top area including the lid 18. This covering 20 is of an air-inflatable structure and is inflated to assume a shape generally similar to a sleeve or tube having a relatively thick tube wall. In FIGS. 1 and 2, the covering 20 is illustrated in an inflated condition wherein it has a generally spherical outer wall 24 having a design of seams 30 printed on it. This provides the covering 20 with an appearance of a large basketball as best shown in FIG. 1. The central hollow 28 (shown in FIG. 3) defined by an inner tubular wall 22 of the inflatable sleeve structure is sized such that when the covering 20 is inflated, it fits around the housing 12. The size dimensions of the covering 20 will be described later in more detail.

The covering 20 is formed of air-impervious flexible sheet material such as plastic (e.g., vinyl, polyethylene, etc.), plastic composite (e.g., fiber-reinforced plastic, plastic-coated fabric, plastic laminate, etc.) or the like. Typically, a plurality of separate sheets of the sheet material, cut or formed in suitable shapes, are joined together to create the inflatable sleeve structure. The exact location of the seams, where the edges of the sheets are joined to another, is a matter of design choice, within the knowledge of persons skilled in the art. For example, the actual seams may be located along the printed seams 30 as well as along the upper and lower edges of the sleeve structure. The seams 32 (only one shown in FIG. 3) along the upper and lower annular edges may be the boundaries between the inner wall 22 and the outer wall 24. Stated differently, the inner and outer sheet walls 22 and 24 are joined together along the upper and lower annular edges to form therebetween a substantially annular air chamber 26. Each of the inner and outer walls 22 and 24 may be formed of a singular piece of sheet of the sheet material. Alternatively, either one or each of the walls 22 and 24 may be formed of a plurality of separate sheets of the sheet material joined together to form the respective wall. The walls 22 and 24 as well as their constituent sheets are joined together by heat sealing or other suitable techniques.

An air inlet/outlet aperture and a valve, of any suitable type, is provided on the covering 20 for inflation and deflation of the covering 20. Such an aperture and a valve, preferably, are located at the position invisible from the outside, such as on the inner wall 22.

Inflation of the covering 20 by admitting air into the valve results in a certain roundness in shape of the covering 20 as the sheet material of the sleeve structure bulges outwardly of the air chamber 26 due to interior air pressure. As a result, the outer wall 24 is bulged outwardly to provide a rounded contour representing a basketball surface as shown in FIGS. 1 and 2. In like manner, the inner wall 22 when free of restraint of the refrigerator 10 can fully bulge inwardly into the central hollow 28 of the covering 20, as best shown by the phantom line in FIG. 2. However, when the covering 20 is on the refrigerator 10 as shown in FIGS. 1 and 2, the inner wall 22 can not be fully bulged but pressed against the housing 12. This allows the covering 20 to fit around the housing 12 and thereby the covering 20 is frictionally retained on the refrigerator 10 without any particular retaining means.

Figure 4:
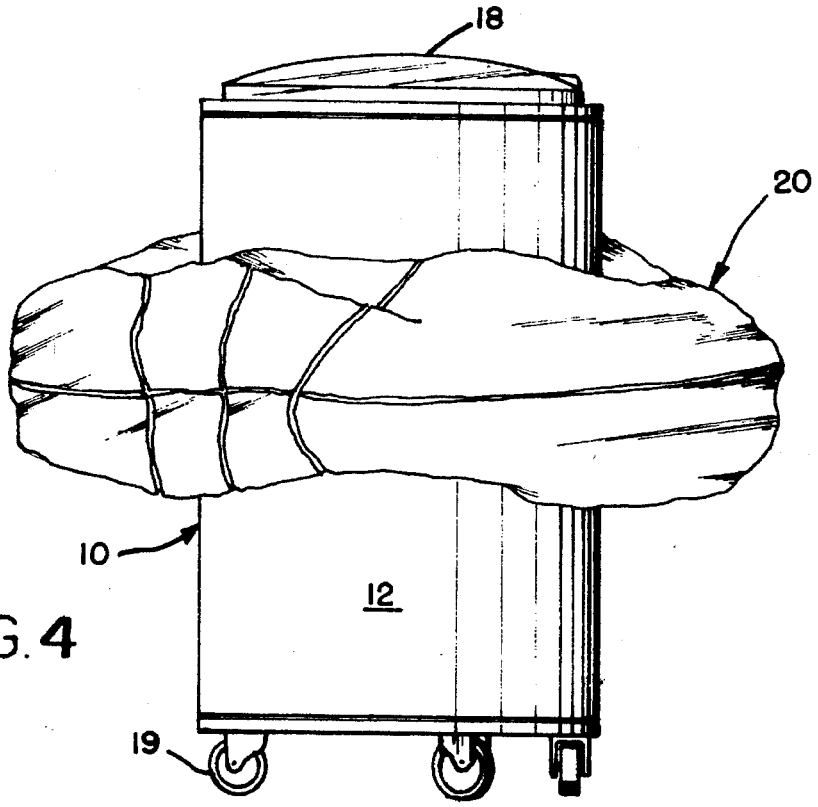
Figure 3:
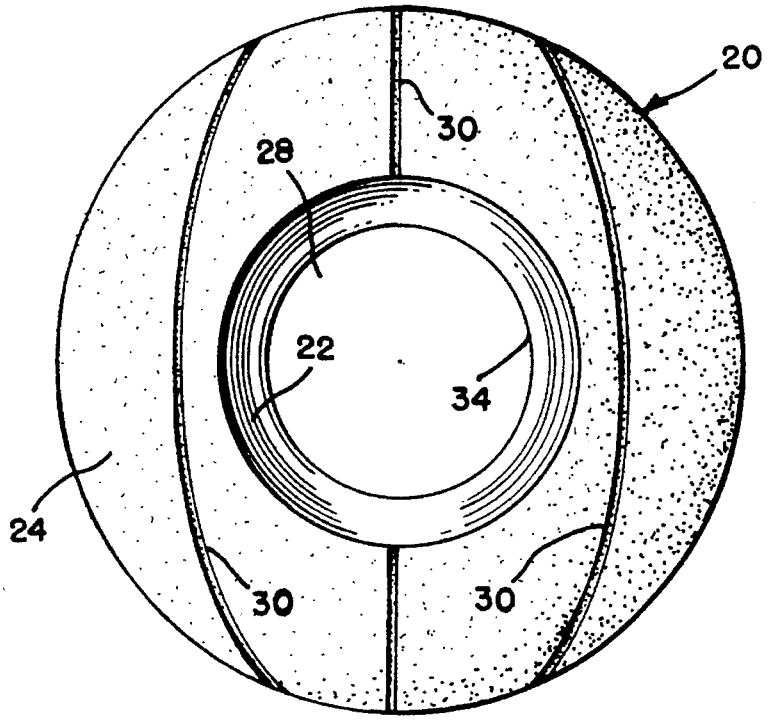
FIG. 3 is a plan view of the inflatable decorative covering in FIG. 1, showing the condition wherein the covering has been inflated and removed from the housing.

FIG. 3 illustrates the covering 20 which has been taken off of the refrigerator 10 and inflated fully with air. In this condition, the inwardly bulged inner wall 22 defines an inner perimeter at the narrowest point of the central hollow 28 along the inner circular edge 34. Such an inner perimeter is less than the outer perimeter of the housing 12 so that the inner wall 22 is pressed against the housing 12 when the covering is applied onto the refrigerator 10. However, when the covering 20 is deflated, the inner wall 22 defines an inner perimeter generally equal to or greater than the outer perimeter of the housing 12. This dimensional arrangement facilitates application and removal of the covering 20 to and from the refrigerator 10. More specifically, it is preferred that the covering 20 is deflated as shown in FIG. 4 and moved up or down along the housing 12 when it should be removed from or applied to the refrigerator 10. However, it should be appreciated that the covering 20 may also be applied to or removed from the refrigerator 10 in its inflated condition.

The covering 20 when inflated and applied to the refrigerator 10 not only provides an attractive three-dimensional billboard area to the housing 12 but also functions as a heat insulator for preventing atmospheric heat from being transferred to the food compartment 14. The heat insulating function owes to the heat-insulating layer formed by the air confined in the air chamber 26.

It will be recognized that many variations may be made to the foregoing within the scope of the present invention. For example, the covering may be formed into a variety of shapes alternative to the basketball, which may include the shapes of different fruits (e.g., apple, orange, peach, pear, strawberry, etc.), vegetables (e.g., tomato, green pepper, egg plant, etc.), tools (e.g., golf ball, baseball, boot, stacked tires), animals, animation characters and the like. These shapes, of course, include those having a circular, oval or polygonal outer perimeter, and those having hollow or inflatable projections on the exteriors.

It will be readily appreciated that the location of the central hollow may vary depending on the shape that is assumed by the covering. In other words, the central hollow does not have to be located at the center of the covering but can be offset from the center. Further, the covering may be provided at the outer wall with a variety of graphics including designs, words, logos and/or advertisements.

It should be further recognized that the covering may cover only a part of the outside surface of the housing instead of covering the entire outside surface. Alternatively, the covering may be extended to the floor on which the device is supported so that it hides the bottom portion of the device including the casters.

It should be further recognized that while the refrigerator is used in the foregoing embodiment, barrel-type display coolers may also be used with the present invention. In addition, barrel-type display refrigerators or coolers having any type of housings may be used with the present invention. Such housings may include those having a circular, oval or polygonal cross section and even those having a slightly outwardly bulged or tapered outside surface. A display cooler having a slightly bulged housing is shown for example in U.S. Pat. No. 5,048,171 whereas a cooler with a tapered housing is shown for example in U.S. Pat. No. 5,169,020.

Figure 5:
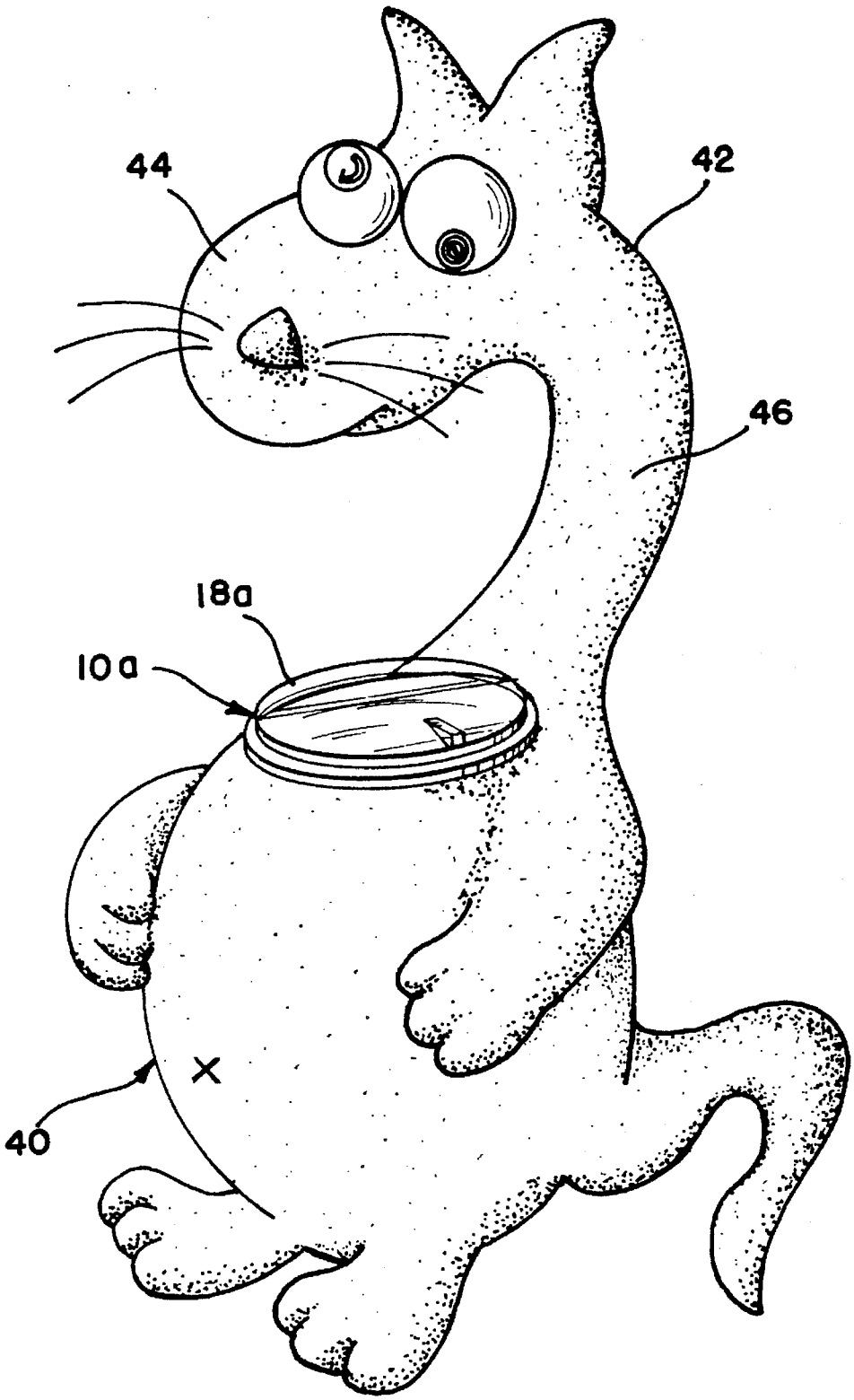
FIG. 5 is a perspective view of a modified form of the display device in FIG. 1.

Other modifications may be made in the foregoing without departing from the scope and spirit of the claimed invention. For example, FIG. 5 illustrates a modified form of the covering 20. The modified inflatable covering 40 is animal-shaped and it has an extension 42 extending upwardly from the outer wall of the covering 40. Such an extension is also of an air-inflatable construction and may have an air chamber in fluid communication with the air chamber of the covering 40. Alternatively, the extension 42 may have an independent air chamber which can be inflated or deflated separately from the main portion of the covering 40 that is disposed around the display device 10*a*. The extension 42 includes a head portion 44 disposed above the lid 18*a* and a neck portion 46 connecting between the head portion 44 and the outer wall of the covering. The size and position of the extension 42 is such that the extension 42 does not interfere with the lid 18*a* during opening and closing operation of the lid 18*a*. The outer wall of the head portion 44 may be used as a billboard surface. The head portion 44 may be formed into any configuration, such as an umbrella shape, suitable for shading the open top of the display device 10*a*. Such a shading portion is particularly useful when the display device 10*a* is placed at an outside location under the sun light.

What is claimed is:

1. A merchandising display device comprising:

an upright tubular housing having a food-chilling compartment defined therein and an open top for permitting access to merchandise in said compartment;

a transparent closure for said open top of said housing; and a removable decorative covering of a deflatably air-inflated sleeve structure disposed around said housing so as to cover at least a part of an outside surface of said housing without blocking said open top, said covering comprising an outer wall defining an outer perimeter of said sleeve structure, said covering being formed of air-impervious flexible sheet material such that said outer wall is bulged outwardly due to internal pressure of said covering to provide a contour different from the contour of said housing, wherein said covering comprises an extension extending upwardly to a position above said closure, said extension comprising a shade means for shading said open top.

2. The device according to claim 1, wherein said covering further comprises an inner wall defining an inner perimeter of said sleeve structure, said inner wall being pressed inwardly against said housing due to said internal pressure whereby said structure is frictionally retained on said housing.

3. The device according to claim 2, wherein said inner and outer wall are joined together to define a substantially annular air chamber therebetween.

4. The device according to claim 1, wherein said covering further comprises an inner wall defining a central hollow of said sleeve structure in which said housing is received, said inner wall being pressed inwardly against said housing due to said internal pressure whereby said structure is frictionally retained on said housing.

5. The device according to claim 1, wherein said covering when deflated has an inner perimeter no less than the outer perimeter of said tubular housing whereby said covering is easily removable from said housing.

6. The device according to claim 1, wherein said extension comprises a head portion disposed over said open top and a neck portion connecting between said head portion and said outer wall, said head portion comprising said shade means.

7. The device according to claim 6, wherein said head portion comprises a front wall for providing a billboard surface.

8. A merchandising display device comprising:

an upright tubular housing having a food-chilling compartment defined therein and an open top for permitting access to merchandise in said compartment;

a transparent closure for said open top of said housing;

a deflatably air-inflated sleeve structure disposed around said housing, said structure being formed of air-impervious flexible sheet material such that air is confined in said structure to form a heat-insulating layer surrounding said housing; and an extension extending upwardly from said sleeve structure to a position above said closure, said extension comprising shade means for shading said open top.

9. The device according to claim 8, wherein said sleeve structure comprises an inner wall defining a central hollow of said structure in which said housing is received, said inner wall being pressed inwardly against said housing due to internal pressure of the structure whereby said structure is frictionally retained on said housing.

10. The device according to claim 8, wherein said sleeve structure when deflated has an inner perimeter no less than the outer perimeter of said housing whereby said structure is easily removable from said housing.

11. The device according to claim 8, wherein said extension comprises a head portion disposed over said open top and a neck portion connecting between said head portion and said outer wall of said sleeve structure, said head portion comprising said shade means.

12. A merchandising display device comprising:

a housing having a food-chilling compartment defined therein and an open to for permitting access to merchandise in said compartment;

an openable transparent closure for said open top of said housing;

shade means for shading said open top, said shade means being retained on said housing and disposed above said closure such that said shade means has no interference with said closure during opening and closing operation of said closure; and a covering disposed around and frictionally retained on said housing so as to cover at least a part of an outside surface of said housing, said covering comprising an extension extending upwardly to a position above said closure, said extension comprising said shade means.

* * * * *

UNITED STATES PATENT AND TRADEMARK OFFICE

CERTIFICATE OF CORRECTION

PATENT NO. : 5,622,261
DATED :APril 22, 1997
INVENTOR(S) : Stephen M. Mobley, et. al.

It is certified that error appears in the above-identified patent and that said Letters Patent is hereby corrected as shown below:

Column 7, line 3, change "to" to --top--. (first occurrence)

Signed and Sealed this

Ninth Day of March, 1999

*Attest:*

Q. TODD DICKINSON

*Attesting Officer*

*Acting Commissioner of Patents and Trademarks*